US005471805A

United States Patent [19]

Becker

[11] Patent Number: 5,471,805

[45] Date of Patent: Dec. 5, 1995

[54] SLIP TRACK ASSEMBLY

[76] Inventor: Duane W. Becker, 34747 CSAH 17, Watkins, Minn. 55389

[21] Appl. No.: 160,406

[22] Filed: Dec. 2, 1993

[51] Int. Cl.[6] ..... E04H 1/00

[52] U.S. Cl. ..... 52/241; 52/481.1; 52/242; 52/290; 52/243.1

[58] Field of Search ..... 52/241, 242, 243.1, 52/344, 738, 481.1, 481.2, 720.1, 290

[56] References Cited

U.S. PATENT DOCUMENTS

| | | | |
|---|---|---|---|
| 2,313,839 | 3/1943 | Olsen | 52/242 |
| 3,397,495 | 8/1968 | Thompson . | |
| 3,481,090 | 12/1969 | Lizee . | |
| 3,744,199 | 7/1973 | Navarre | 52/241 |
| 3,759,001 | 9/1973 | Judkins et al. | 52/481.1 |
| 3,861,103 | 1/1975 | Rasmussen . | |
| 3,900,996 | 8/1975 | Yohe . | |
| 4,229,918 | 10/1980 | Delcroix . | |
| 4,283,892 | 8/1981 | Brown | 52/241 |
| 4,833,849 | 5/1989 | Williams et al. | 52/481.1 |
| 5,127,760 | 7/1992 | Brady . | |
| 5,203,132 | 4/1993 | Smolik | 52/242 |

FOREIGN PATENT DOCUMENTS

| | | | |
|---|---|---|---|
| 1374956 | 9/1964 | France | 52/242 |

OTHER PUBLICATIONS

Memorandum from the Office of Statewide Health Planning and Development, Apr. 20, 1993, re Deflection Track Detail.

Catalog of Unimast Incorporated, Steel Framing Components and Accessories for Drywall, Plaster and Load-Bearing Construction, 1992. See p. 14.

Catalog of United States Gypsum Company, Systems Folder SA-923—1993 Edition, Drywall/Steel Framed Systems. See pp. 9, 23, 25, 30. 1993.

Technical Book of Unimast Incorporated, Steel Framing Systems Technical Information, 1991. See pp. 4, 28.

Brochure from Metal-Lite, Inc. re: "SLP-TRK" Slotted Track.

"New Solution for an Old Problem", *Walls & Ceilings*, Aug. 1994, pp. 40–41.

1991 Unimast Corp. Catalog.

UL Report on "Perimeter Relief Runner System Details of Use in Nonbearing Walls", Jun. 23, 1966, pp. 1–C4.

Engineering Study on "Perimeter Relief System for Use in Nonbearing Partition Systems", Factory Mutual Research Corporation, Jun. 18, 1969, pp. 1–20.

*Primary Examiner*—Carl D. Friedman
*Assistant Examiner*—Winnie S. Yip
*Attorney, Agent, or Firm*—Merchant, Gould, Smith, Edell, Welter & Schmidt

[57] ABSTRACT

A slip track assembly having a slip track and a non-combustible secondary wall member which together are fastened to an overhead roof structure and slidingly receive the studs and primary wall member of a non-load bearing stud wall so as to provide a desired fire barrier connection.

4 Claims, 3 Drawing Sheets

SLIP TRACK ASSEMBLY

FIELD OF THE INVENTION

The present invention is directed generally to the field of construction and, more particularly, to fire barrier connections between a non-load bearing stud wall and an overhead structure.

BACKGROUND OF THE INVENTION

There appears to be an increasing awareness among architects and specification writers of the need to protect the public through the use of fire-rated partitions. Code officials also are more aggressively enforcing fire codes and paying closer attention to the many details that are necessary in firewall construction. They are taking these actions to ensure that fire-rated partitions perform as intended. Building codes typically require fireproof ratings of one hour, two hours, or some other time period for walls and connections between walls and the roof or other overhead structure.

A typical wall to roof connection is an inverted U-shaped longitudinal slip track which receives studs between the legs of the U-shaped track. A wall board is attached to at least one side of the studs. One of the legs of the slip track is received between the studs and the wall board. The studs and wall board are spaced from the overhead structure or roof in order to allow for settling or other movement of the overhead structure or roof with respect to the wall. A caulking is installed next to the slip track in the space between the wall board and the overhead structure. The caulking and wall board have the appropriate fire rating.

Problems with this typical connection is that not only is the caulking expensive, but it has a tendency to harden and crack during settling of the overhead structure. The caulking can then crumble away and leave voids.

SUMMARY OF THE INVENTION

The present invention is directed to a slip track assembly for connecting a stud wall and an overhead structure. The slip track assembly includes a slip track with parallel first and second surfaces offset from one another on a common side of the studs of the wall. The track also includes a third surface on the opposite side of the studs. The track has a horizontal surface extending between two of the surfaces so that the horizontal surface can be fastened to the overhead structure. The slip track assembly further includes a non-combustible secondary wall member and mechanism for attaching the secondary wall member to the second surface of the slip track. The secondary wall member has an edge adjacent to the overhead structure and is slidable with respect to a primary wall member attached to the studs.

The slip track assembly eliminates the need for caulking and rather, as a result of the shape of the slip track, provides for use of a secondary wall member to complete a fire barrier between the primary wall member and the overhead structure, such as a roof.

The method of using the slip track assembly for providing a fire barrier connection between a stud wall and an overhead structure includes attaching the slip track to the overhead structure, installing the studs in a sliding relationship between the first and third surfaces of the slip track and attaching the primary wall member to the studs so as to have a sliding relationship with the first surface of the slip track, and attaching the secondary wall member to the second surface of the slip track so as to be adjacent to the overhead structure and to have a sliding relationship with the primary wall member.

The present invention is thus simple, economical, environmentally friendly, and easy to install since it uses the same materials as those required to construct the stud wall.

DETAILED DESCRIPTION OF THE PREFERRED EMBODIMENT

Figure 1:
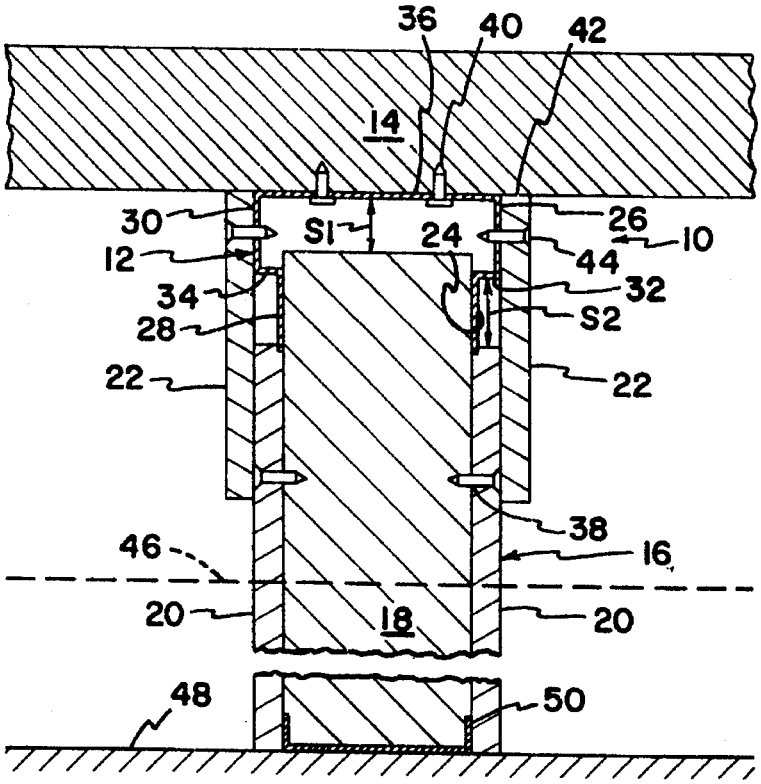
FIG. 1 is a cross-sectional view showing in profile a slip track assembly in accordance with the present invention.

Referring now to the drawings wherein like reference numerals designate identical or corresponding parts throughout the several views, and more particularly to FIG. 1, a preferred slip track assembly in accordance with the present invention is designated generally by the numeral 10. Slip track assembly 10 includes a slip track 12 fastened to an overhead structure 14, such as a roof. A non-load bearing stud wall 16 is formed from a plurality of studs, such as the stud 18 shown, and a primary wall member 20 attached thereto. A secondary wall member 22 is attached to slip track 12 and extends between overhead structure 14 and primary wall member 20.

Slip track 12 is shown in FIG. 1 as a unitary member. Slip track 12 has any convenient length. It is preferably metallic. Slip track 12 has parallel first and second surfaces 24 and 26 offset from one another on a common side of studs 18. Slip track 12 includes third and fourth surfaces 28 and 30 on an opposite side of stud 18. Stud 18 is received between the portions of slip track 12 identified as first and third surfaces 24 and 28. Horizontal surfaces 32 and 34 extend between first and second surfaces 24 and 26 and between third and fourth surfaces 28 and 30, respectively. A horizontal surface 36 extends between surfaces 26 and 30.

Primary wall member 20 is fastened to stud 18 in a conventional fashion, as with screws 38. Stud 18 is commonly a metallic post, but could be wood or other material conventionally used as a stud. Primary wall member 20 is commonly gypsum board, but could be other wall material having a required fire rating for the particular application. In that regard, it is understood that primary wall member 20 could also be multiple layers of wall material to create the required fire rating. Stud 18 is spaced from roof structure 14 a distance S1. Distance S1 is commonly about one inch, but could be more. Likewise, primary wall member 20 is spaced a distance S2 from horizontal surface 32. Distance A2 is also generally approximately one inch, but could be more. The primary wall member on the opposite side of stud 18 as member 20 is installed similarly. First and third surfaces 24 and 28 have a sliding relationship between the primary wall members and stud 18.

Slip track 12 is attached to roof structure 14 with screws 40 or other common attachment mechanisms.

Secondary wall member 22 extends from having an edge 42 adjacent to overhead structure 14 down to and overlapping in a slidable relationship with primary wall member 20. Secondary wall member 22 is attached to second surface 26 with screws 44 or other conventional fastening mechanism.

Similarly, a secondary wall member on the side of stud 18 opposite secondary wall member 22 is shown attached to slip track 12. The secondary wall members are made of material similar to the primary wall members and have a similar thickness so as to provide a similar fire rating.

Slip track assembly 12 is necessarily adjacent to and attached to an overhead structure, such as a roof. In that regard, the ceiling of a room may be spaced beneath assembly 10 as shown by line 46. A floor 48 is also shown.

In use, the embodiment of FIG. 1 involves attaching slip track 12 to overhead structure 14 with screws 40. Studs 18 are retained and otherwise fastened in a conventional way between a track 50 attached to floor 48 and first and third surfaces 24 and 28 of slip track 12. The primary wall members 20 are attached to studs 18 so that primary wall members 20 can slide between secondary wall members 22 and first or third surfaces 24 or 28, while stud 18 is allowed to also slide relative to first and third surfaces 24 and 28. Finally, secondary wall members 22 are fastened to second and fourth surfaces 26 and 30. Secondary wall members 22 cover the space between the top end of primary wall members 20 and the overhead structure 14 and do so in a way which allows movement between slip track structure attached to overhead structure 14 and the stud wall structure. Thus, the overhead structure 14, slip track 12, and secondary wall members 22 can move relative to studs 18 and primary wall members 20 the distances S1 or S2, the two distances being very similar in length.

Figure 2:
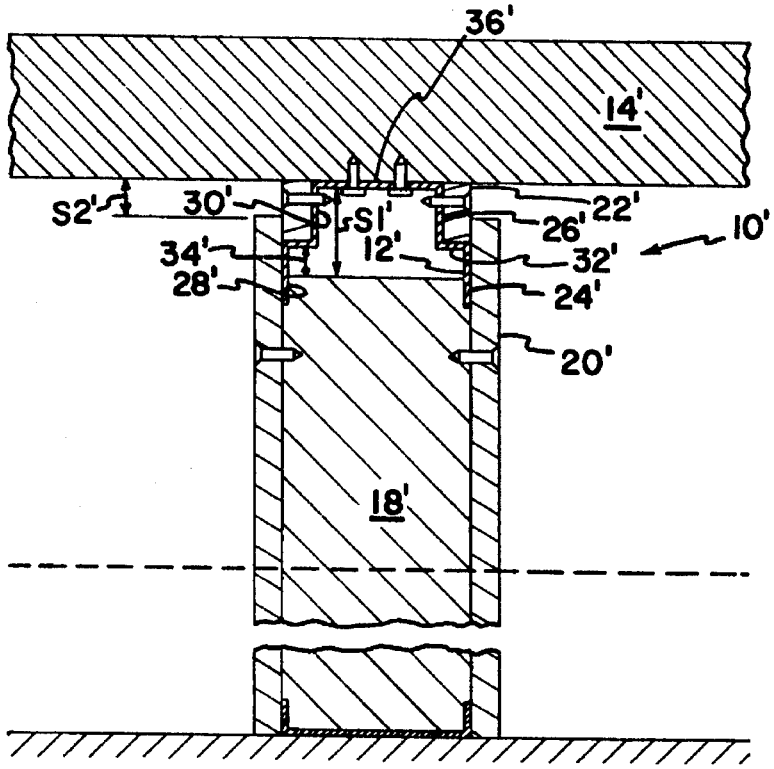
FIG. 2 is a cross-sectional view showing an alternate embodiment.

A second embodiment is shown in FIG. 2 wherein like structure to that of FIG. 1 is identified by like numerals, only primed. In that regard, slip track 12' has a different shape which results in secondary wall members 22' being on the inside of primary wall members 20'. Otherwise, the construction of the second embodiment is the same as the first embodiment.

Slip track 12' has first and third surfaces 24' and 28' spaced apart further from one another than second and fourth surfaces 26' and 30'. Horizontal surfaces 32' and 34' extend between first and second surfaces 24' and 26' and between third and fourth surfaces 28' and 30'. Horizontal surface 36' extends between second and fourth surfaces 26' and 30' and is attached to the overhead structure 14'. Secondary wall members 22' fill the space between horizontal surfaces 32', 34' and overhead structure 14'. Stud 18' is spaced a distance S1' from horizontal surfaces 32' and 34', while primary wall members 20' are spaced a distance S2' from overhead structure 14'. In this way, slip track 12' and primary and secondary wall members 20' and 22' function to provide a fire barrier between the stud wall and the overhead structure. At the same time, space is provided for settling and expansion.

Figure 3:
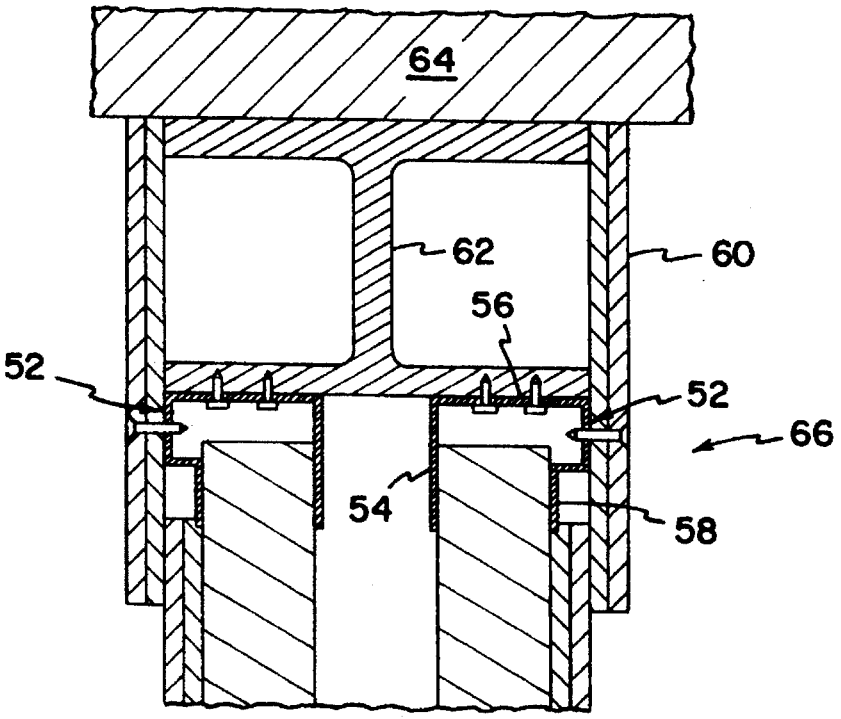
FIGS. 3–7 are further alternatives shown generally in cross-section and illustrating variations on the general shapes of the embodiments of FIGS. 1 and 2.

The embodiments shown in FIGS. 3–7 illustrate further variations possible. In FIG. 3, a pair of slip tracks 52 are shown with each having a single vertical surface 54 extending to horizontal surface 56 which is attached to the overhead structure. The stud is received between the first surface 58 and surface 54. Secondary wall members 60 are shown in double layer, are attached to second surface 53, and extend beyond slip track 52 and a beam 62 to roof 64. Slip track assembly 66 functions, however, similar to slip track assemblies 10 and 10'. A mirror image of slip track assembly 66 and the construction associated with it is shown on the left of FIG. 3. Such mirror image construction need not, however, be necessary depending on the construction of a particular facility.

Figure 4:
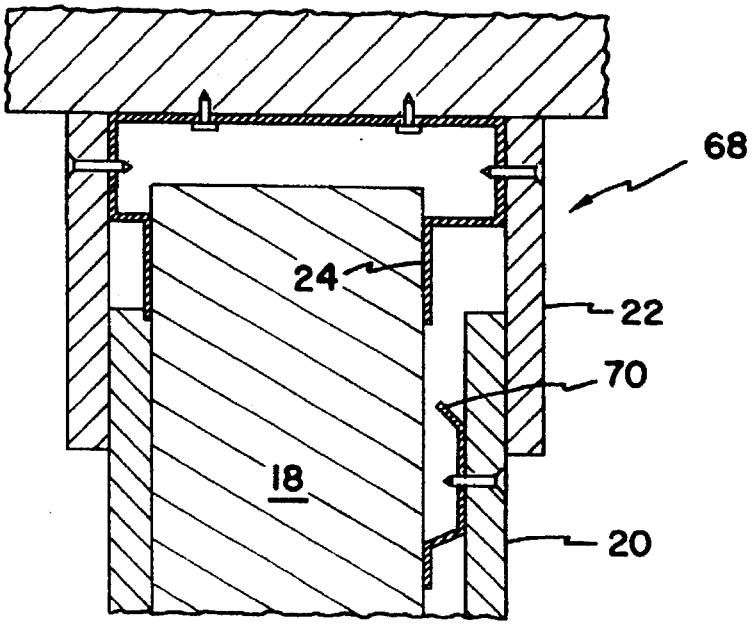

Slip track assembly 68 in FIG. 4 is the same as slip track assembly 10 except that one of primary wall members 20 is spaced from stud 18 by a spacer 70. Although primary wall member 20 and secondary wall member 22 are in an overlapping, sliding relationship with one another, primary wall member 20 is not in contact with first surface 24.

Figure 5:
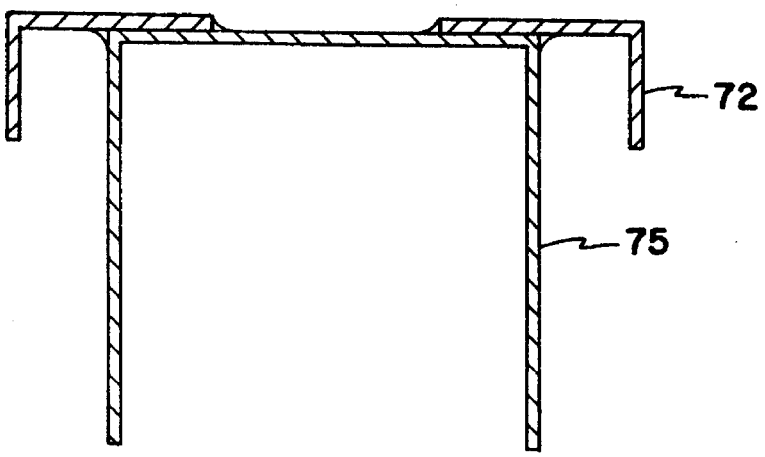
Figure 6:
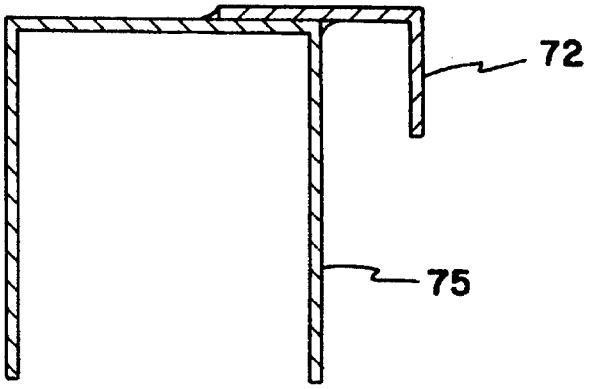
Figure 7:
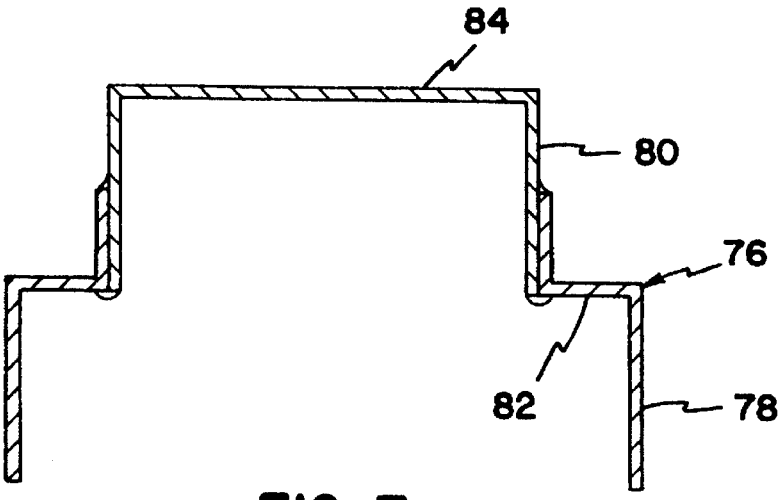

The embodiments of slip tracks shown in FIGS. 5–7 illustrate integral members, not necessarily unitary. With respect to FIG. 5, the third surfaces 72 are formed by one leg of an L-shaped piece screwed, pop riveted, welded, or otherwise fastened to an inverted U-shaped member 74. A similar result is achieved on one side as shown in FIG. 6. With respect to FIG. 7, the reverse profile of FIG. 2 is obtained using a member 76 having offset parallel surfaces 78,80 running in opposite directions from a horizontal surface 82. One of the parallel surfaces, for example, surface 80 is fastened to an inverted U-shaped member 84.

It is further noted that the slip tracks of the present invention can also be used vertically or in other orientations at dissimilar constructions to provide a fire barrier and provide for expansion.

The present invention, thus, achieves a fire barrier connection which provides for movement between the overhead structure and the stud wall. The slip track assembly functions in a telescoping fashion. In this way, there is no material which has to be compressed so as to be subject to possible hardening and breaking. The slip track assembly can be constructed with materials which provide for an appropriate fire rating. The assembly then maintains for the lifetime of the materials the fire protection desired.

Thus, numerous characteristics and advantages of the invention have been set forth, together with details of structure and function. It is to be understood, however, that the disclosure is illustrative only. Therefore, any changes made, especially in matters of shape, size, and arrangement, to the full extent extended by the general meaning of the terms in which the appended claims are expressed, are within the principle of the invention.

What is claimed is:

1. Between a stud wall and an overhead structure, said stud wall having a plurality of studs with a primary noncombustible wall member attached thereto, said studs and said primary wall member being spaced from said overhead structure, a slip track assembly comprising:

a slip track mechanism with parallel first and second surfaces offset from one another on a common side of said studs, said mechanism including a third surface on a side opposite said common side, third surface and one of said first and second surfaces being spaced apart so that said studs may move therebetween, said mechanism further including a horizontal surface connecting between said second and third surfaces to fasten to said overhead structure, said mechanism also including means for connecting said second surface with said overhead structure;

a noncombustible secondary wall member; and means for attaching said secondary wall member to said second surface so that said secondary wall member can have an edge adjacent to said overhead structure and be slidable with respect to said primary wall member;

wherein on installation said first and second surfaces of said slip track mechanism and said secondary wall member relative to said primary wall member provide a slidable fire barrier connection between said overhead structure and said stud wall.

2. The assembly in accordance with claim 1 wherein said slip track mechanism includes first and second members fastened together, said first member providing said first and third surfaces and said second member providing said second surface.

3. The assembly in accordance with claim 1 wherein said slip track mechanism includes first and second members fastened together, said first member providing said first and second surfaces and said second member providing said third surface.

4. A method for using a slip track assembly for providing a fire barrier connection between a stud wall and an overhead structure, said stud wall including a plurality of studs and a noncombustible primary wall member, said slip track assembly including a slip track mechanism with offset parallel first, second, and third surfaces, said slip track assembly further including a noncombustible secondary wall member, said method comprising the steps of:

attaching said slip track mechanism to said overhead structure installing said studs between said first and third surfaces of said slip track mechanism so that said studs can move therebetween said surfaces and attaching said primary wall members to said studs; and attaching said secondary wall member to said second surface of said slip track mechanism so as to be adjacent to said overhead structure and to have a sliding relationship with said primary wall member.

* * * * *